US005376013A

United States Patent [19]

Sawada

[11] Patent Number: 5,376,013

[45] Date of Patent: Dec. 27, 1994

[54] CONNECTOR

[75] Inventor: Hisashi Sawada, Yokkaichi, Japan

[73] Assignee: Sumitomo Wiring Systems, Ltd., Yokkaichi, Japan

[21] Appl. No.: 83,507

[22] Filed: Jun. 30, 1993

[30] Foreign Application Priority Data

Aug. 5, 1992 [JP] Japan ..... 4-054977[U]

[51] Int. Cl.[5] ..... H01R 13/52

[52] U.S. Cl. ..... 439/271; 439/595

[58] Field of Search ..... 439/271-283

[56] References Cited

U.S. PATENT DOCUMENTS

| | | | |
|---|---|---|---|
| 3,937,545 | 2/1976 | Cairns | 439/271 |
| 4,421,373 | 12/1983 | Ratchford et al. | 439/271 |
| 4,556,226 | 12/1985 | Ito . | |
| 4,611,872 | 9/1986 | Ito et al. . | |
| 4,820,181 | 4/1989 | Kuzuno et al. . | |
| 4,917,620 | 4/1990 | Samejima et al. | 439/271 |

FOREIGN PATENT DOCUMENTS

| | | |
|---|---|---|
| 0132099 | 1/1985 | European Pat. Off. . |
| 0440417 | 8/1991 | European Pat. Off. . |

*Primary Examiner*—David L. Pirlot

*Attorney, Agent, or Firm*—Sandler Greenblum & Bernstein

[57] ABSTRACT

An engaging hole is formed in the housing of a female connector. A waterproof rubber ring is provided on the inner surface of the engaging hole so that the waterproof rubber ring seals the space between the inner surface of the engaging hole and the outer surface of a male connector inserted into the housing of the female connector. A plurality of stopper convex portions is formed on the outer surface of the waterproof rubber ring. A plurality of stopper concave portions which is to be engaged by each of the stopper convex portions is formed on the inner surface of the housing of the female connector.

1 Claim, 3 Drawing Sheets

CONNECTOR

BACKGROUND OF THE INVENTION

1. Field of the Invention

The present invention relates to a connector and more particularly, the connector comprising a waterproof rubber ring provided in an engaging hole formed in the housing of a female connector so as to seal the space between the inner surface of the engaging hole and the outer surface of a male connector inserted into the female connector, namely, prevent the occurrence of a breakdown effectively.

2. Description of the Related Arts

An example of a conventional connector of this kind is described below with reference to FIGS. 6 and 7. A waterproof rubber ring 2 is installed in an engaging hole 1*a*, formed on a housing 1 of the female connector, for inserting the male connector (not shown) thereinto. The waterproof rubber ring 2 is provided to seal the space between the inner peripheral surface of the engaging hole 1*a* and the peripheral surface of the male connector. A pair of stopper projections 2*a* and 2*a* is formed on the peripheral surface of the rubber ring 2. A pair of stopper openings 1*b* and 1*b* is formed on the peripheral surface of the connector housing 1. Each of the stopper projections 2*a* and 2*a* engages each of the stopper openings 1*b* and 1*b*. In this manner, the rubber ring 2 is fixed to the connector housing 1.

The stopper openings 1*b* and 1*b* penetrate through the wall of the connector housing 1. There is a short insulation distance between a terminal (not shown) inserted into a terminal accommodating hole 1*c* (not shown) as well as a connector (not shown) of the male connector and the peripheral surface of the connector housing 1. Consequently, if a high voltage is applied from the terminals to a metal component adjacent to the peripheral surface of the connector housing 1, electric current flows from the terminals to the metal component via the stopper openings 1*b* and 1*b*. As a result, a breakdown occurs in the connector housing 1.

SUMMARY OF THE INVENTION

It is an object of the present invention to provide a connector in which the occurrence of a breakdown can be effectively prevented.

In accomplishing these and other objects, there is provided a connector comprising a waterproof rubber ring provided on the inner surface of an engaging hole formed in a housing of a female connector so as to seal the space between the inner surface of the engaging hole and the outer surface of a housing of a male connector inserted into the housing of the female connector. A plurality of stopper convex portions is formed on the outer surface of the waterproof rubber ring. A plurality of stopper concave portions which is engaged by each of the stopper convex portions is formed on the inner surface of the housing of the female connector.

According to the above-described construction, a plurality of stopper concave portions formed on the inner surface of the housing of the female connector is engaged by each of the stopper convex portions formed on the outer surface of the waterproof rubber ring. A part of the peripheral wall between the bottom surface of each stopper concave portion and the outer surface of the housing of the female connector maintains insulating performance effectively. Accordingly, there is a comparatively long insulating distance between terminals accommodated in the accommodating chamber of the housing of the female connector and a metal component adjacent to the outer surface of the housing of the female connector. Thus, even though a high voltage is applied from the terminals to the metal component, leakage is unlikely to occur. Thus, no breakdown occurs in the housing of the female connector.

Moreover, owing to the part of the peripheral wall between the bottom surface of each stopper concave portion and the outer surface of the housing of the female connector, the stopper convex portions of the rubber ring are not exposed to dust or rain. Accordingly, the housing of the female connector has a preferable insulating performance and thus the rubber ring is durable.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
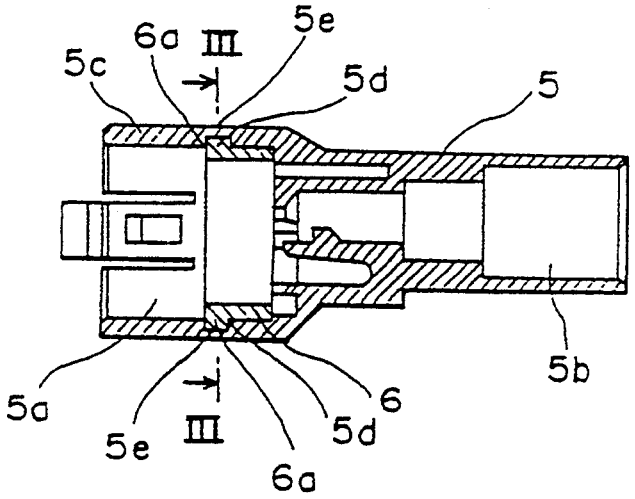
FIG. 1 is a sectional side elevation showing a connector housing according to the present invention.

Before the description of the present invention proceeds, it is to be noted that like parts are designated by like reference numerals throughout the accompanying drawings.

A connector according to an embodiment of the present invention is described below with reference to the drawings.

Figure 2:
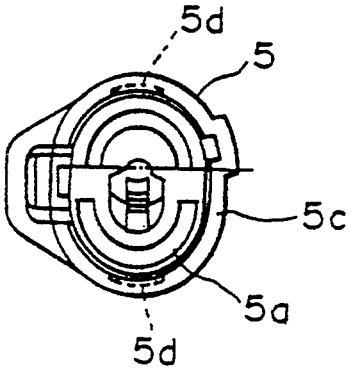
FIG. 2 is a front view of the connector housing shown in FIG. 1.

Referring to FIGS. 1 and 2, an engaging hole 5*a* and an accommodating chamber 5*b* are formed in a cylindrical connector housing 5 of a female connector comprising an insulating material made of synthetic resin or the like. A male connector (not shown) is inserted into the connector housing 5 through the engaging hole 5*a*. A terminal is accommodated in the accommodating chamber 5*b*.

Figure 3:
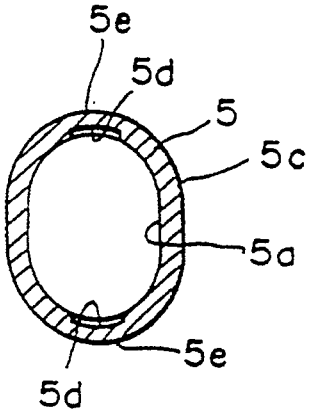
FIG. 3 is a sectional view of the connector housing taken along a line III—III of FIG. 1.

A pair of stopper concave portions 5*d* and 5*d* is formed on the inner peripheral surface of the engaging hole 5*a* of the connector housing 5 as shown in FIGS. 2 and 3. The line connecting the stopper concave portions 5*d* and 5*d* with each other divides the circumference of the engaging hole 5*a* equally as shown in FIGS. 2 and 3.

The stopper concave portions 5*d* and 5*d* do not penetrate through the peripheral wall 5*c* of the connector housing 5, but are formed in a certain distance from the inner surface of the connector housing 5 toward the outer surface thereof.

Figure 4:
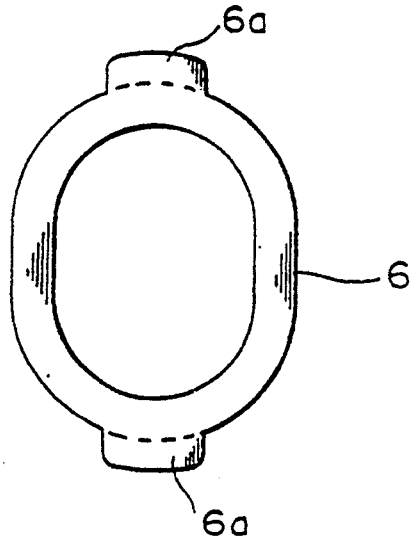
FIG. 4 is a front view showing a rubber ring.
Figure 5:
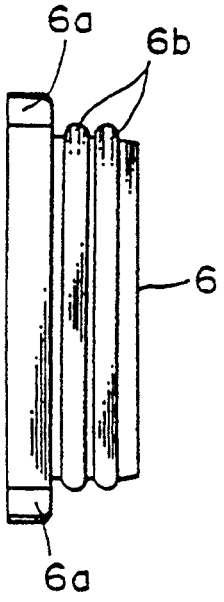
FIG. 5 is a side elevational view of the rubber ring shown in FIG. 4.
Figure 6:
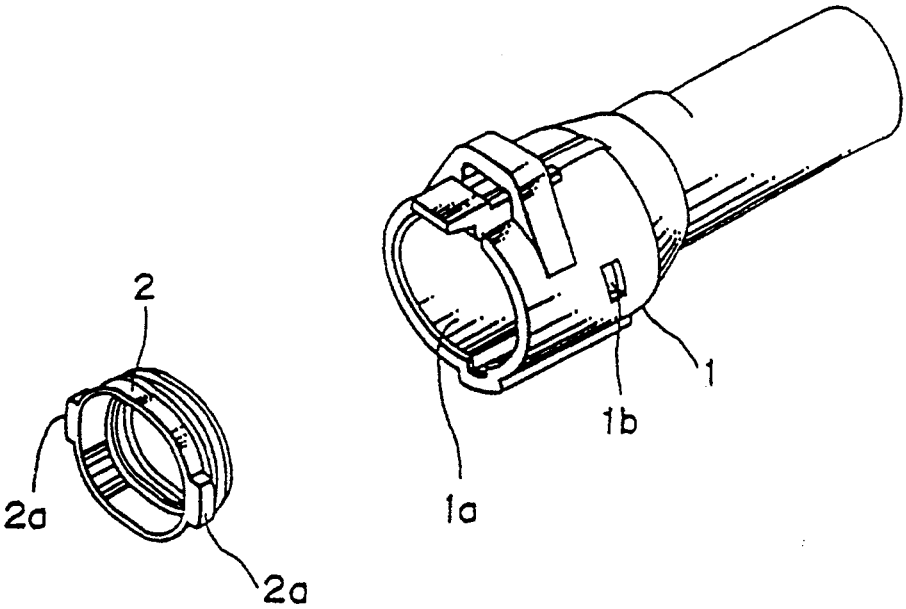
Fig. 6 PRIOR ART
FIG. 6 is a perspective view showing a conventional connector housing.
Figure 7:
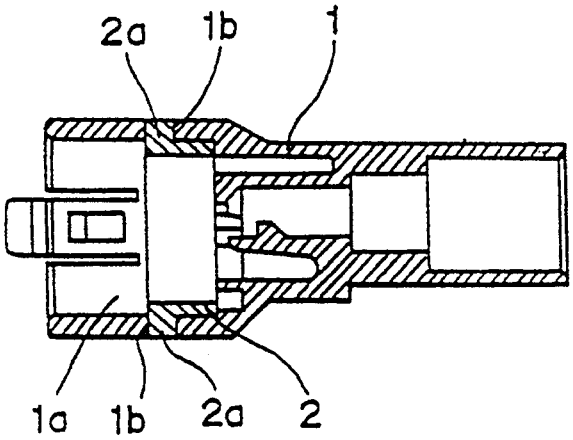
Fig. 7 PRIOR ART
FIG. 7 is a sectional side elevation showing the conventional connector housing of FIG. 6.

Referring to FIGS. 4 and 5, the outer surface of a waterproof rubber ring 6 engages the inner peripheral surface of the connector housing 5, and the inner surface thereof engages the outer surface of the connector housing of the male connector inserted into the female connector. A pair of stopper convex portions 6a and 6a and contact projections **6*b* and 6*b* are formed on the outer surface of the rubber ring 6. Each of the stopper convex portions 6*a* and 6*a* inserted into the connector housing 5 engages each of the stopper concave portions 5*d* and 5*d*** radially.

In assembling the connector having the above-described construction, the rubber ring 6 is inserted into the engaging hole **5*a* of the connector housing 5, and each of the stopper convex portions 6*a* and 6*a* of the rubber ring 6 is inserted into each of the stopper concave portions 5*d* and 5*d* so that the former is engaged by the latter. In this manner, the rubber ring 6 is fixed to the connector housing 5** at a predetermined position thereof.

Then, the male connector is inserted into the engaging hole **5*a* of the connector housing 5** so as to connect the terminals of both connectors with each other.

At this time, the outer surface of the male connector closely contacts the inner surface of the rubber ring 6 in engagement therewith, and the outer surface of the rubber ring 6 closely contacts the inner surface of the engaging hole **5*a* of the connector housing 5 in engagement therewith, thus watertightly sealing the space between the male connector and the rubber ring 6 and the space between the rubber ring 6 and the connector housing 5**.

In the embodiment, as described previously, since the stopper concave portions **5*d* and 5*d* do not penetrate through the peripheral wall 5*c* of the connector housing 5, a part 5*e* of the peripheral wall 5*c* between the bottom surface of each of the stopper concave portions 5*d* and 5*d* and the outer surface of the connector housing 5** maintains insulating performance effectively.

Accordingly, there is a comparatively long insulating distance between the terminals accommodated in the accommodating chamber **5*b* of the connector housing 5 and projecting from the engaging hole 5*a* and a metal component adjacent to the outer surface of the connector housing 5. Even though a high voltage is applied from the terminals to the metal component, leakage is unlikely to occur. Thus, no breakdown occurs in the connector housing 5 and thus the connector housing 5** is durable.

Since the stopper convex portions **6*a* and 6*a* of the rubber ring 6 is covered with the peripheral wall 5*c* of the connector housing 5, the stopper convex portions 6*a* and 6*a* are not exposed to dust or rain. In this respect, the connector housing 5 has a preferable insulating performance and thus the rubber ring 6** is durable.

In addition, when the male connector is removed from the engaging hole **5*a* of the connector housing 5 by pulling the male connector from the connector housing 5, rain does not stay in the engaging hole 5*a*, whereas in the conventional connector housing described previously, rain stays in the stopper hole 1*b*, thus penetrating into the engaging hole 1*a***.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector comprising an elliptical waterproof rubber ring provided on the inner surface of an engaging hole formed in an elliptical housing of a female connector so as to seal the space between the inner surface of the engaging hole and the outer surface of an elliptical housing of a male connector inserted into the housing of the female connector, in which a plurality of stopper convex portions are formed on an elliptical outer surface of the waterproof rubber ring; and a plurality of stopper concave portions, which are engaged by each of the stopper convex portions, are formed on an elliptical inner surface of the housing of the female connector, and a part of a peripheral wall between the bottom surface of each stopper concave portion and the outer surface of the housing of the female connector effectively maintains insulating performance.

* * * * *